US009763549B2

(12) United States Patent
Hyun et al.

(10) Patent No.: US 9,763,549 B2
(45) Date of Patent: Sep. 19, 2017

(54) VACUUM CLEANER

(71) Applicant: LG ELECTRONICS INC., Seoul (KR)

(72) Inventors: Kietak Hyun, Seoul (KR); Philjae Hwang, Seoul (KR); Mantae Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 552 days.

(21) Appl. No.: 14/445,465

(22) Filed: Jul. 29, 2014

(65) Prior Publication Data

US 2015/0320278 A1 Nov. 12, 2015

(30) Foreign Application Priority Data

May 7, 2014 (KR) ..... 10-2014-0054188

(51) Int. Cl.

| | |
|---|---|
| ***A47L 9/04*** | (2006.01) |
| ***A46B 7/10*** | (2006.01) |
| ***A46B 13/00*** | (2006.01) |
| *A47L 9/06* | (2006.01) |

(52) U.S. Cl.

CPC ..... *A47L 9/0477* (2013.01); *A46B 7/10* (2013.01); *A46B 13/001* (2013.01); *A47L 9/0411* (2013.01); *A47L 9/066* (2013.01)

(58) Field of Classification Search

CPC .... A47L 11/4041; A47L 9/066; A47L 9/0477; A47L 9/04; A46B 7/10; A46B 13/001

USPC ..... 15/179, 182, 183, 41.1

See application file for complete search history.

(56) References Cited

U.S. PATENT DOCUMENTS

| | | | | |
|---|---|---|---|---|
| 2,242,678 A | | 5/1941 | Riebel, F., Jr. | |
| 2,251,899 A | * | 8/1941 | Smellie | A47L 5/34 15/182 |
| 2,271,551 A | * | 2/1942 | Hoover | A47L 5/34 15/182 |

(Continued)

FOREIGN PATENT DOCUMENTS

| | | |
|---|---|---|
| CN | 201668349 | 12/2010 |
| CN | 102240191 | 11/2011 |

(Continued)

OTHER PUBLICATIONS

European Search Report dated Sep. 21, 2015 issued in Application No. 14178327.4.

(Continued)

*Primary Examiner* — David Redding
(74) *Attorney, Agent, or Firm* — KED & Associates, LLP

(57) ABSTRACT

Disclosed is a vacuum cleaner. The vacuum cleaner includes a suction nozzle housing, an agitator provided within the suction nozzle housing, and a suction channel guiding air sucked into the suction nozzle housing to a dust collector, the agitator includes a body rotatably installed in the suction nozzle housing, brush members disposed on the body in parallel with the center of rotation of the body and combined with the body so as to be fixed, and auxiliary members disposed on the body in parallel with the center of rotation of the body and combined with the body so as to be movable when the body is rotated, and a protrusion overlapping with parts of the brush members and contacting the brush members when the body is rotated is provided in the suction channel.

16 Claims, 8 Drawing Sheets

(56) References Cited

U.S. PATENT DOCUMENTS

| | | | | |
|---|---|---|---|---|
| 2,271,553 | A * | 2/1942 | Smellie | A47L 5/34 15/182 |
| 5,109,976 | A | 5/1992 | Mohri et al. | |
| 5,611,109 | A | 3/1997 | Worwag | |
| 7,159,276 | B2 | 1/2007 | Omoto et al. | |
| 9,326,654 | B2 * | 5/2016 | Doughty | A47L 9/0477 |
| 2006/0162121 | A1 | 7/2006 | Naito et al. | |
| 2009/0229075 | A1 | 9/2009 | Eriksson | |
| 2010/0287725 | A1 | 11/2010 | Jeong et al. | |
| 2010/0306956 | A1 | 12/2010 | Follows et al. | |
| 2013/0232703 | A1 | 9/2013 | Jang et al. | |

FOREIGN PATENT DOCUMENTS

| | | | |
|---|---|---|---|
| CN | 202096154 | | 1/2012 |
| DE | 10 2007 036 227 | A1 | 2/2009 |
| DE | 20 2009 001 640 | U1 | 7/2010 |
| EP | 1 642 520 | A1 | 4/2006 |
| EP | 1 994 869 | A2 | 11/2008 |
| EP | 2 443 978 | A2 | 4/2012 |
| KR | 10-2005-0068138 | A | 7/2005 |
| KR | 10-2013-0025309 | A | 3/2013 |
| KR | 10-2013-0141825 | A | 12/2013 |
| WO | WO 2005/004695 | | 1/2005 |
| WO | WO 2012-001854 | A1 | 1/2012 |

OTHER PUBLICATIONS

Russian Office Action issued in Application No. 2014128150 dated Jul. 3, 2015.

Australian Office Action issued in Application No. 2014203697 dated Jun. 3, 2015.

* cited by examiner

VACUUM CLEANER

This application claims the benefit of Korean Patent Application No. 10-2014-0054188, filed on May 7, 2014, which is hereby incorporated by reference as if fully set forth herein.

BACKGROUND OF THE INVENTION

Field of the Invention

The present invention relates to a vacuum cleaner and more particularly, to a vacuum cleaner which may prevent foreign substances from jamming in an agitator.

Discussion of the Related Art

In general, a vacuum cleaner is an apparatus which sucks external air by vacuum pressure generated from a motor provided in a main body and may thus remove dust and other foreign substances.

Such a vacuum cleaner basically includes a motor provided within a main body and generating vacuum pressure and a dust collection box collecting dust and other foreign substances, and a suction nozzle sucking air and foreign substances is provided on the main body.

When a user operates the vacuum cleaner having the above configuration under the condition that the suction nozzle contacts on an object to be cleaned, such as a floor or a carpet, air and foreign substances are sucked into the suction nozzle by vacuum pressure of the motor and move to a filter or a cyclone device provided in the main body and then, the foreign substances enter the dust box and the air passes through the motor and is discharged to the outside of the main body.

An agitator installed in the suction nozzle is rotated to separate foreign substances from a cleaned surface. Here, when the agitator contacts the cleaned surface while being rotated, foreign substances having a long length, such as hair, may jam in the agitator.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner which may prevent foreign substances from jamming in an agitator.

Another object of the present invention is to provide a suction nozzle of a vacuum cleaner which may easily clean a surface and prevent overloading of a motor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes a suction nozzle housing, an agitator provided within the suction nozzle housing, and a suction channel guiding air sucked into the suction nozzle housing to a dust collector, wherein the agitator includes a body rotatably installed in the suction nozzle housing, brush members disposed on the body in parallel with the center of rotation of the body and combined with the body so as to be fixed, and auxiliary members disposed on the body in parallel with the center of rotation of the body and combined with the body so as to be movable when the body is rotated, wherein a protrusion overlapping with parts of the brush members and contacting the brush members when the body is rotated is provided in the suction channel.

The protrusion may be provided at an entrance of the suction channel.

The protrusion may be provided at the upper portion of the entrance of the suction channel and the body may be rotated upward from a region below the protrusion.

The protrusion may be disposed at the center of the body and shield a part of the cross-section of the entrance in the widthwise direction.

The protrusion may be formed integrally with the suction channel.

The brush members may extend from the center of rotation of the body to a greater length than the auxiliary members.

The brush members may be more easily deformed than the auxiliary members.

The auxiliary members may extend so as not to contact the protrusion.

A recess may be formed at a position of each of the auxiliary members corresponding to the protrusion.

The main body may include reception grooves, each of the auxiliary members may include a coupling part received in each of the reception grooves, and the coupling part may have a smaller size than the size of the reception grooves so as to be movable within each of the reception grooves.

One auxiliary member may be disposed at each of both sides of one brush member along the circumference of the body.

The two auxiliary members may be disposed adjacent to the one brush member interposed therebetween.

The number of the auxiliary members may be twice the number of the brush members on the body.

The vacuum cleaner may further include a drive motor installed in the suction nozzle housing and connected to the agitator to rotate the agitator.

The suction nozzle housing may include a base plate, a top plate covering the upper surface of the base plate and forming a space in which the agitator is received, and a transparent plate installed on the top plate and allowing a user to observe the agitator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
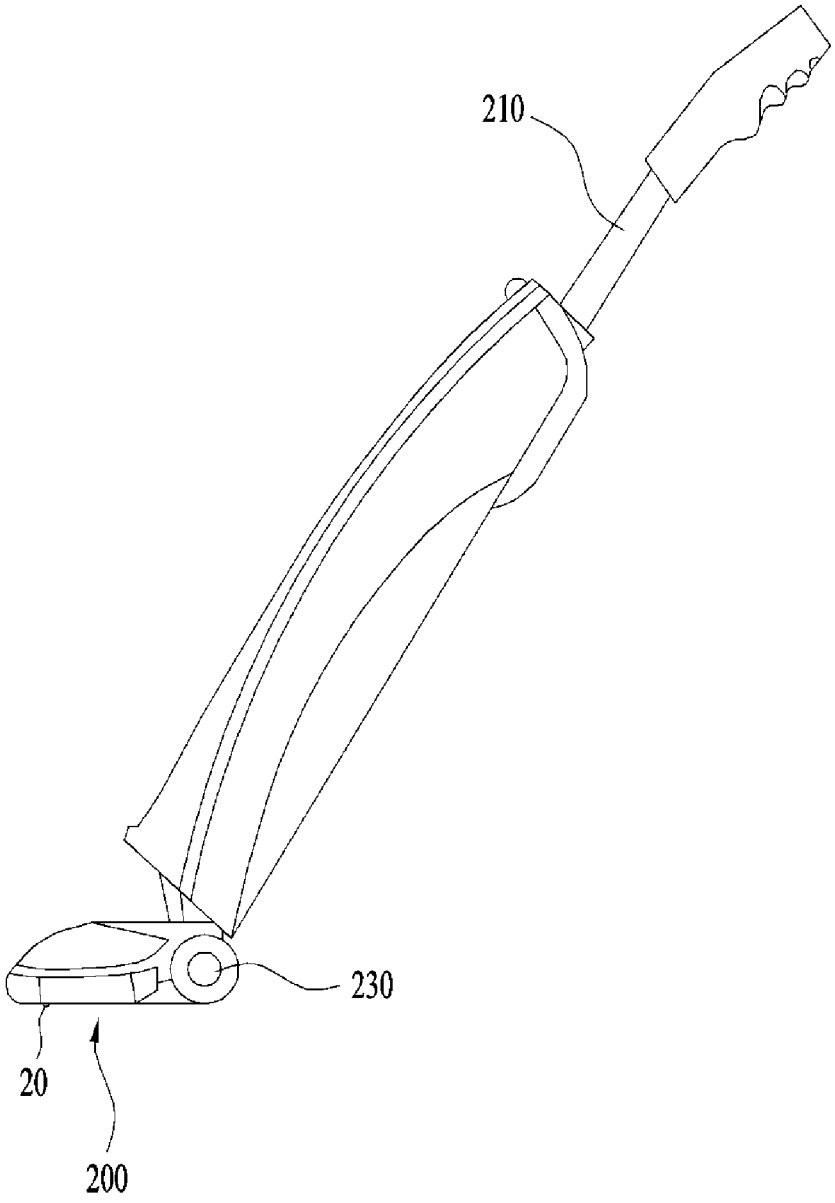
FIG. 1 is a perspective view illustrating a vacuum cleaner in accordance with one embodiment of the present invention.

Reference will now be made in detail to the preferred embodiments of the present invention, examples of which are illustrated in the accompanying drawings.

In the drawings, the sizes or shapes of elements may be exaggerated for clarity and convenience of description. Further, terms specially defined in the following description in consideration of the configuration and functions of the present invention may be changed according to the intention of a user or an operator or a usual practice. The definitions of these terms should be determined based on the whole content of this specification.

FIG. 1 is a perspective view illustrating a vacuum cleaner in accordance with one embodiment of the present invention. Hereinafter, the vacuum cleaner in accordance with the embodiment of the present invention will be described with reference to FIG. 1.

The vacuum cleaner includes a stick unit 210 provided with a stick handle at the upper portion thereof and a suction nozzle 200 provided with a rotatable agitator 20 on the lower surface thereof, and the stick unit 210 and the suction nozzle 200 may be connected by a connection unit, such as a hinge 230. The stick unit 210 is provided on a main body of the vacuum cleaner and a user may move the vacuum cleaner by operating the stick unit 210.

The suction nozzle 200 is provided with the agitator 20 and is thus rotatable on a cleaned surface.

The agitator 20 installed on the suction nozzle 200 may easily float foreign substances attached to a cleaned surface, such as a hard floor or a carpet, during cleaning and thus, improve cleaning performance.

A dust collector to collect foreign substances sucked through the suction nozzle 200 is provided within the vacuum cleaner. Air and foreign substances sucked through the suction nozzle 200 are guided to the dust collector. The foreign substances may be collected within the dust collector and the air may be discharged again to the outside. A suction unit, such as a fan, providing suction force to the suction nozzle 200 is provided within the main body.

Figure 2:
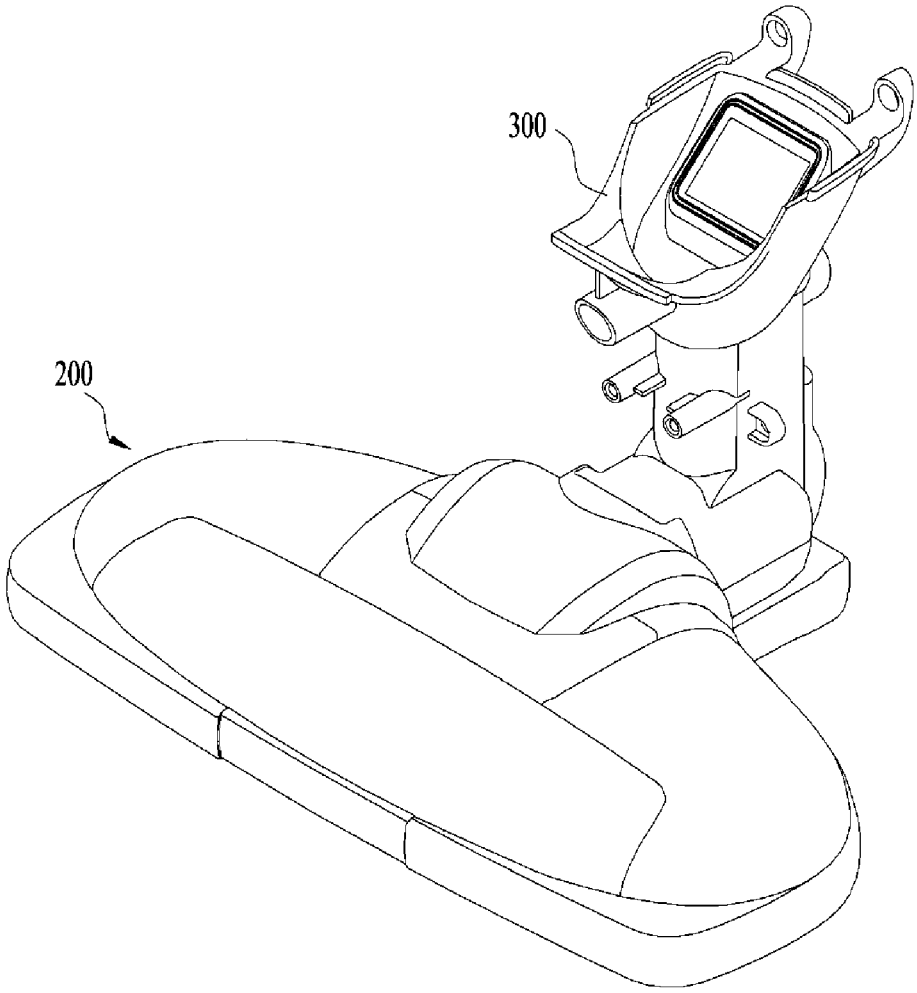
FIG. 2 is a perspective view illustrating an essential portion of a suction nozzle in accordance with the embodiment of the present invention.
Figure 3:
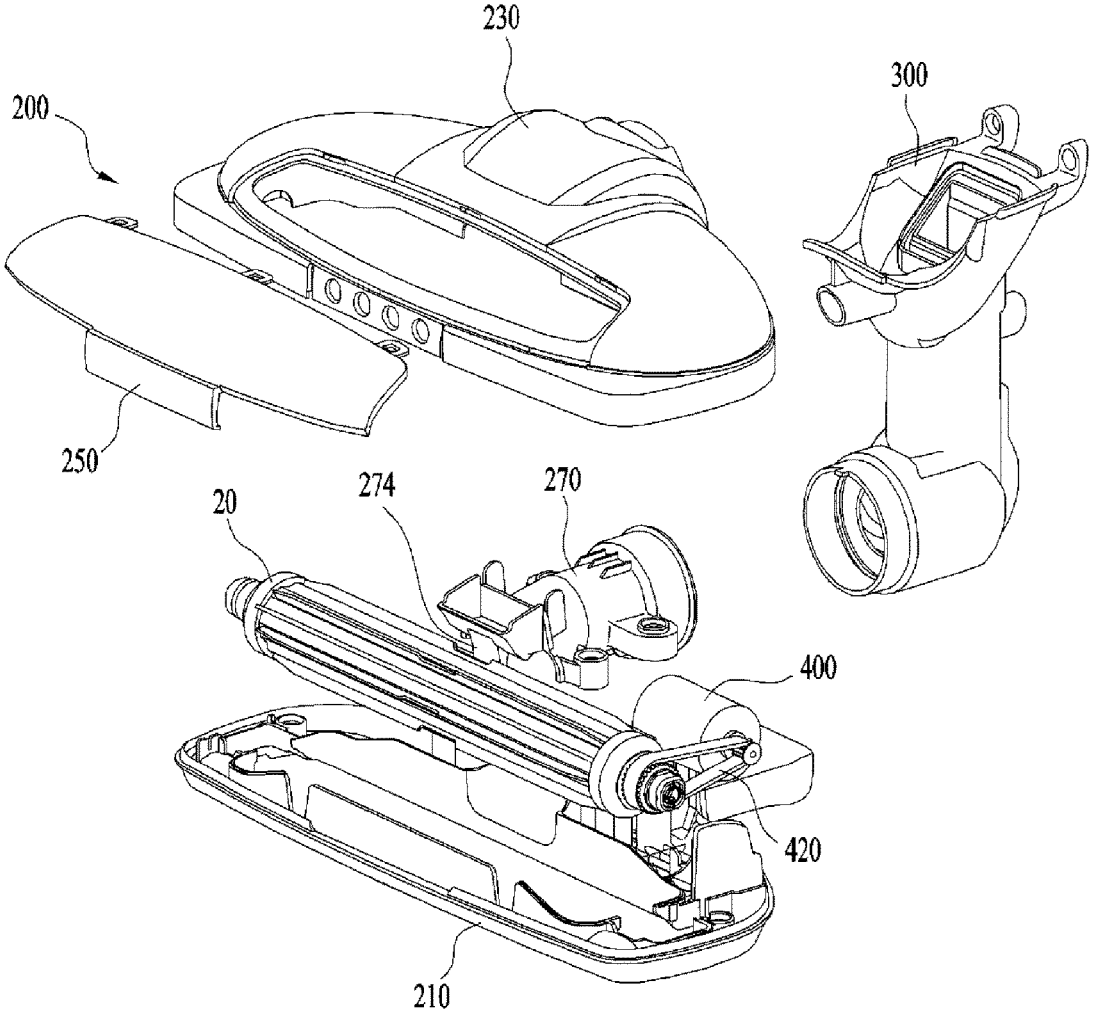
FIG. 3 is an exploded perspective view of FIG. 2.
Figure 4:
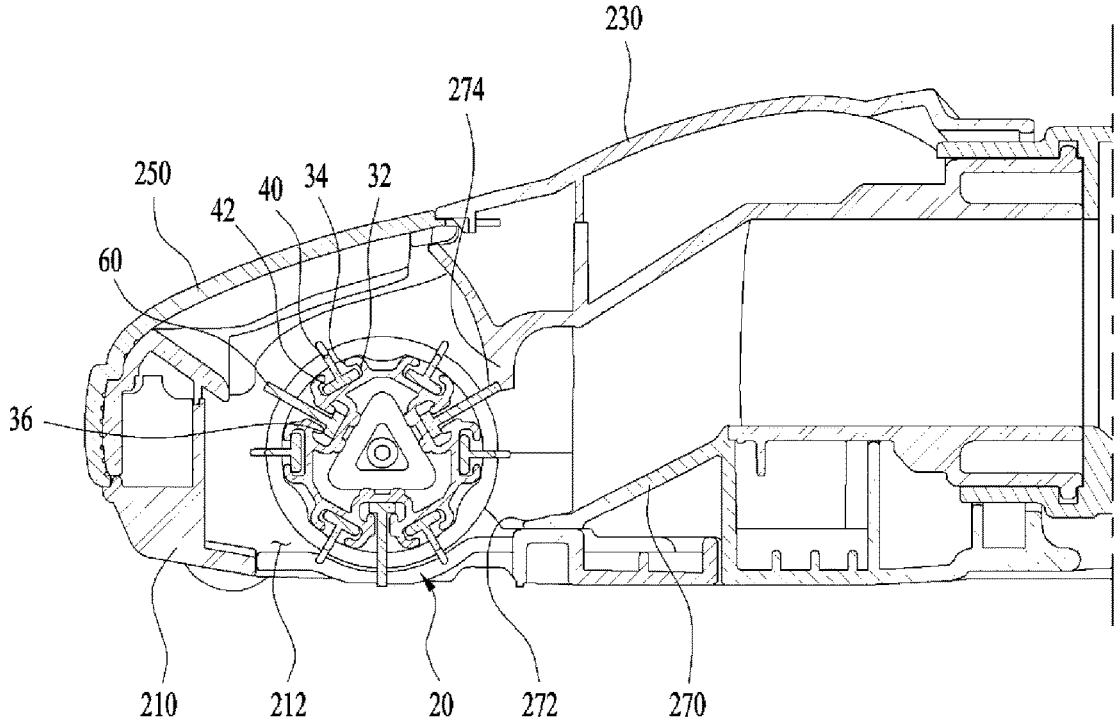
FIG. 4 is a longitudinal-sectional view of FIG. 2.

FIG. 2 is a perspective view illustrating an essential portion of the suction nozzle in accordance with the embodiment of the present invention, FIG. 3 is an exploded perspective view of FIG. 2, and FIG. 4 is a longitudinal-sectional view of FIG. 2. Hereinafter, the suction nozzle will be described with reference to FIGS. 2 to 4.

The suction nozzle 200 in accordance with the embodiment of the present invention includes a suction nozzle housing forming the external appearance of the suction nozzle 200, the agitator 20 rotatably provided within the suction nozzle housing, and a suction channel 270 guiding air sucked into the suction nozzle housing to the dust collector.

The suction channel 270 is provided so as to communicate with a main body channel 300 communicating with the dust collector of the main body. The main body channel 300 may provide a passage along which air and foreign substances sucked through the suction nozzle housing may be guided to the dust collector.

The suction nozzle housing may include a base plate 210, a top plate 230 covering the upper surface of the base plate 210 and forming a space in which the agitator 20 is received, and a transparent plate 250 installed on the top plate 230 and allowing a user to observe the agitator 20.

A suction hole 212 is formed on the base plate 210 and a part of the agitator 20 may contact a cleaned surface through the suction hole 212. Since the suction hole 212 has a similar length to that of the agitator 20, a part of the agitator 20 may hit the cleaned surface throughout the lengthwise direction. The suction channel 270 may provide suction force, provided through the main body channel 300, to the suction nozzle 200.

The top plate 230 may provide a space in which the agitator 20 is rotatable and a space in which a drive motor 400 driving the agitator 20 is received.

The drive motor 400 and the agitator 20 are connected by a pulley 420 and thus rotary force of the drive motor 400 may be transmitted to the agitator 20. Further, the drive motor 400 may generate rotary force by power supplied from a power supply line connected from the main body to the outside or a storage battery provided within the main body.

The transparent plate 250 may be installed on the top plate 230. The transparent plate 250 may be formed of a transparent material so that a user may observe the agitator 20 rotated and hitting the cleaned surface.

A protrusion 274, which may overlap with and contact some elements of the agitator 20, may be provided at an entrance 272 of the suction channel 270. The protrusion 274 is provided at the entrance 272 of the suction channel 270 and may intermittently contact the agitator 20 when the agitator 20 is rotated. That is, as the agitator 20 is rotated, the agitator 20 sequentially contacts and does not contact the protrusion 270.

Figure 5:
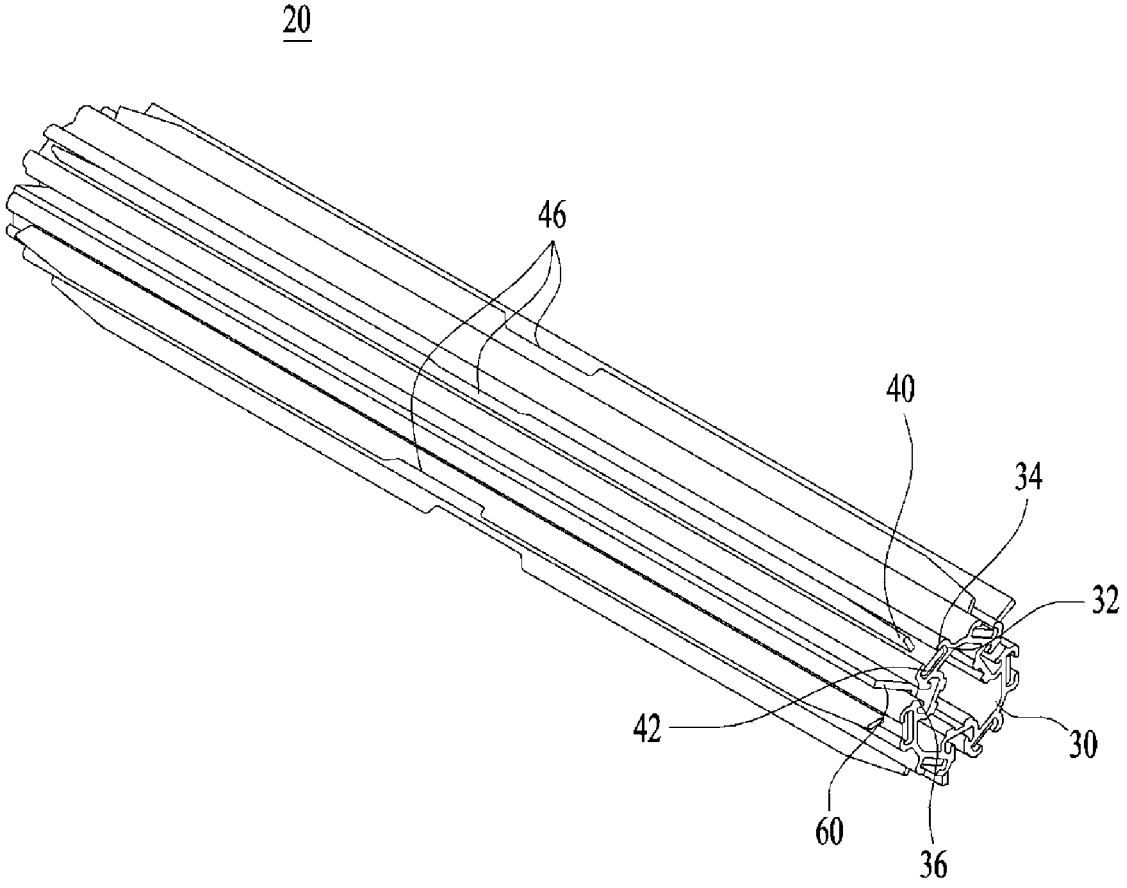
FIG. 5 is a perspective view illustrating an agitator.
Figure 6:
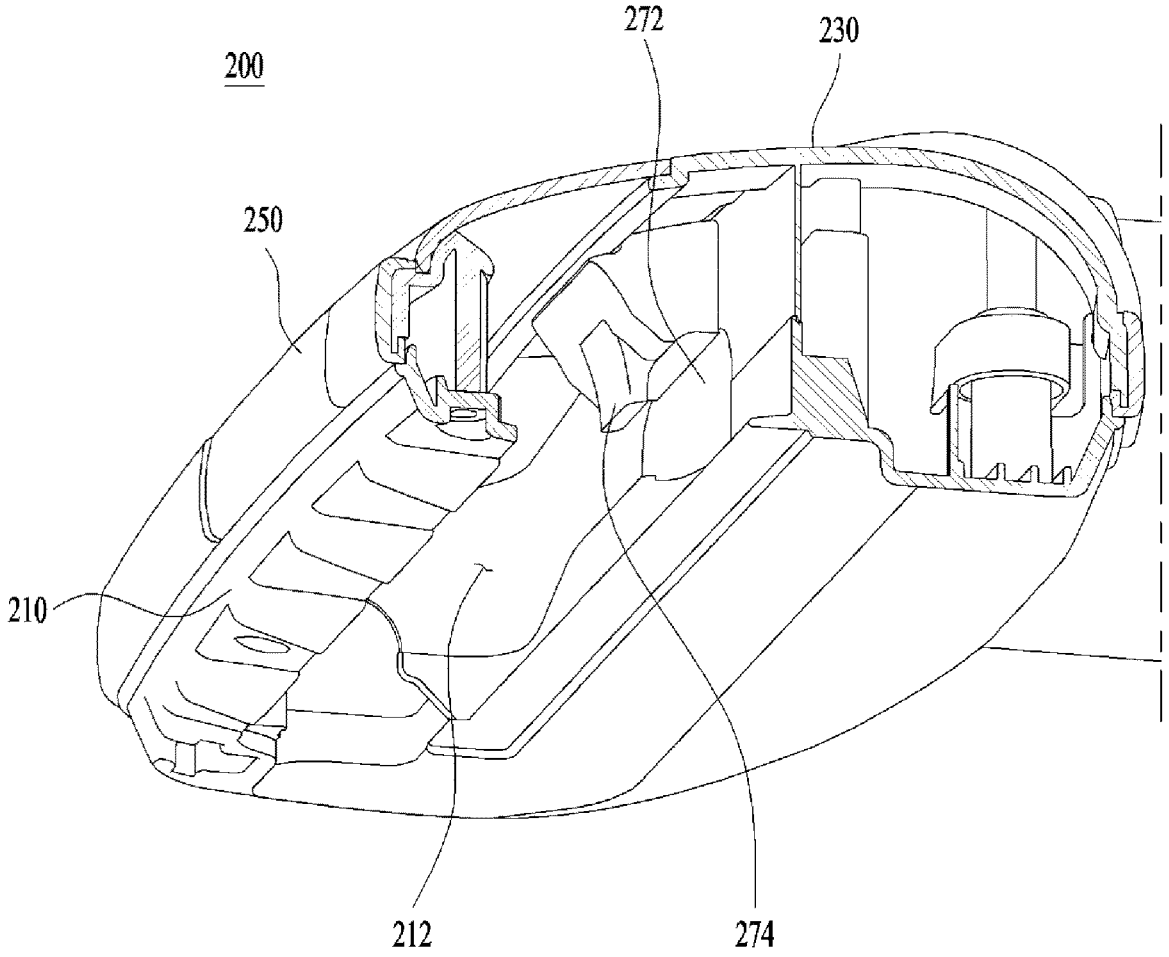
FIG. 6 is a view of the suction nozzle from which the agitator is removed, as seen from the bottom.
Figure 7:
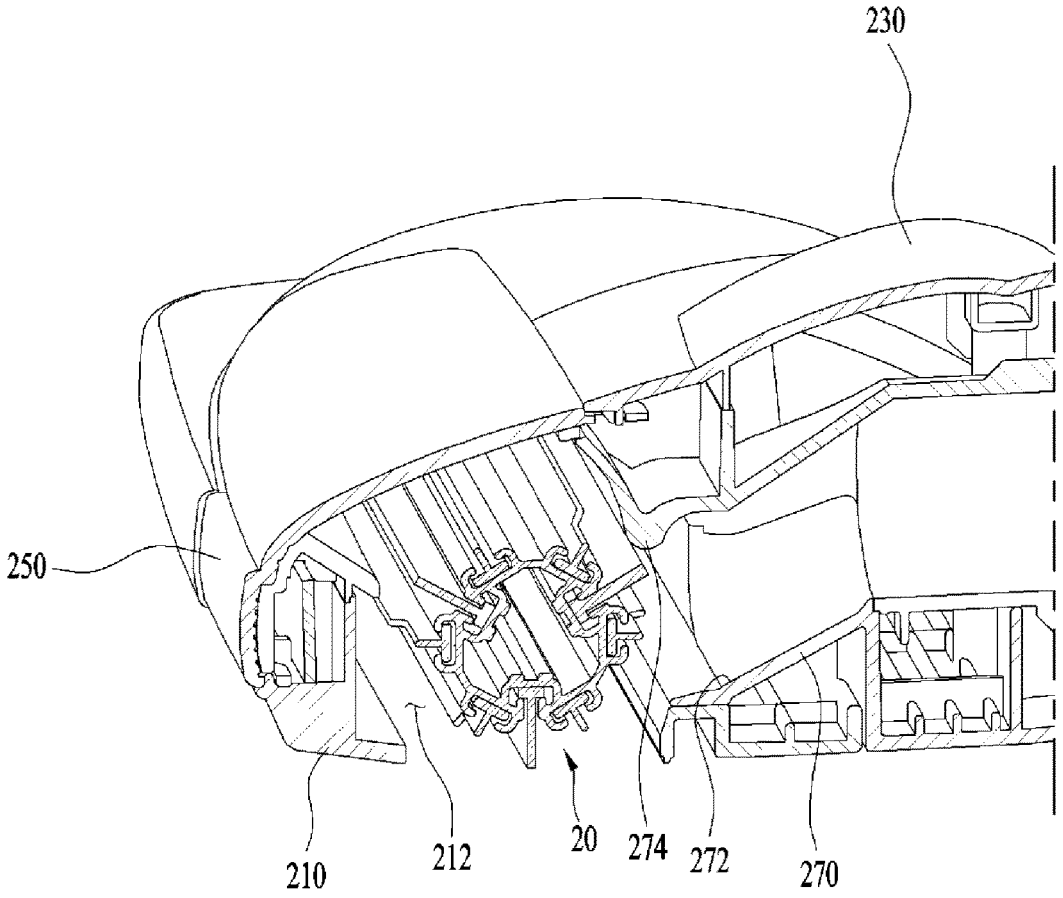
FIG. 7 is a longitudinal-sectional view illustrating the suction nozzle.
Figure 8:
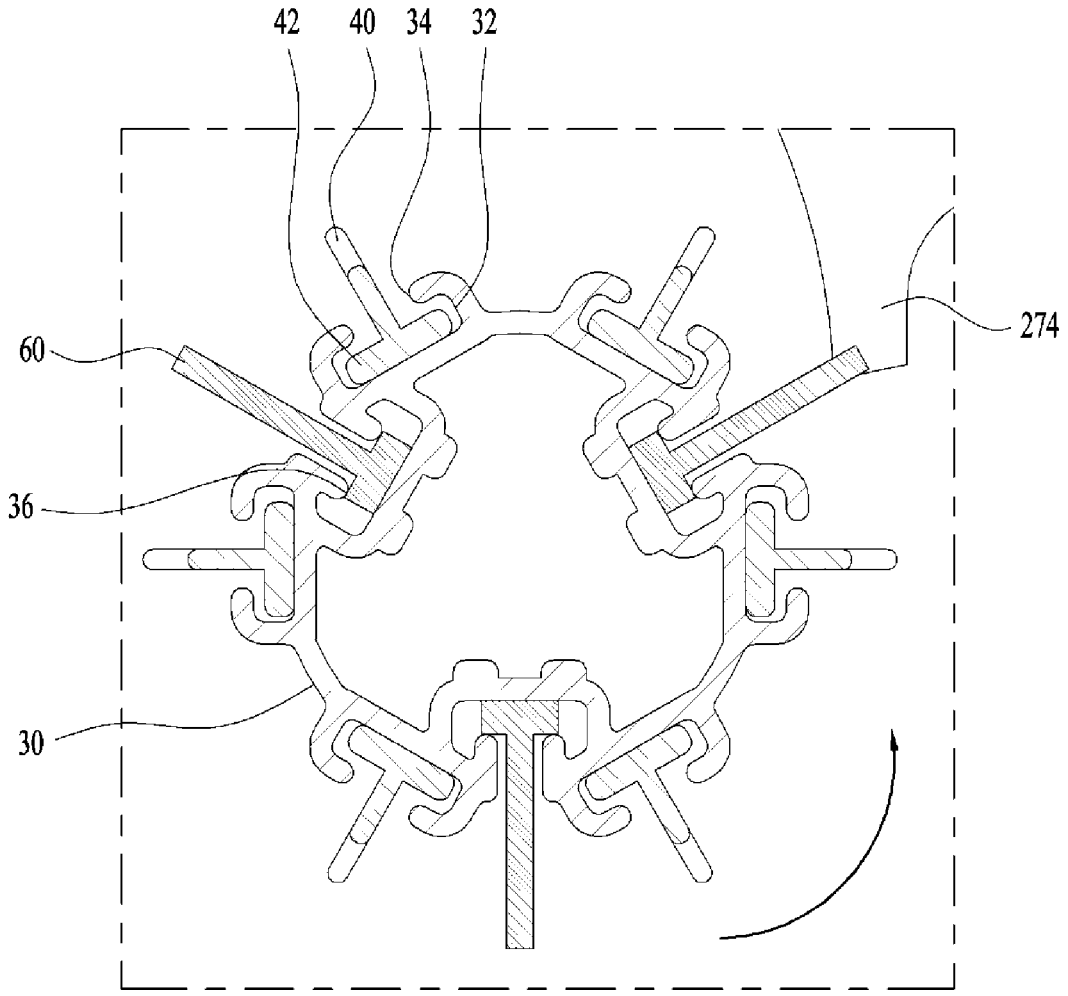
FIG. 8 is a view illustrating a body and a protrusion.

FIG. 5 is a perspective view illustrating an agitator, FIG. 6 is a view of the suction nozzle from which the agitator is removed, as seen from the bottom, FIG. 7 is a longitudinal-sectional view illustrating the suction nozzle, and FIG. 8 is a view illustrating a body and the protrusion. Hereinafter, the agitator will be described with reference to FIGS. 5 to 8.

The agitator 20 may include a body 30 installed on the suction nozzle housing so as to be rotatable, brush members 60 provided on the body 30 in parallel with the center of rotation of the body 30 and combined with the body 30 so as to be fixed, and auxiliary members 40 provided on the body 30 in parallel with the center of rotation of the body and combined with the body 30 so as to be movable.

The body 30 is connected to the pulley 420 and rotated by rotary force transmitted from the drive motor 400. The body 30 may have the shape of a rod extended in the lengthwise direction.

The brush members 60 including plural bristles may be disposed on the body 30 in the lengthwise direction. The brush members 60 may float foreign substances from a cleaned surface, such as a carpet or a floor, by hitting or scraping the carpet or the floor during cleaning.

The brush members 60 are inserted into second through holes 36 formed on the body 30 and thus fixed. Since both ends of the brush members 60 are combined with the second through holes 36 by insertion, even when the body 30 is rotated, the brush members 60 do not move relative to the body 30. The width of the brush members 60 is the same as the width of the second through holes 36 and thus the brush members 60 may be fixed.

The auxiliary members 40, which are movable when the body 30 is rotated, are disposed on the body 30 in the lengthwise direction. The auxiliary members 40 may float foreign substances from a cleaned surface, such as a carpet, by hitting the carpet during cleaning.

Each of the auxiliary members 40 includes a first coupling part 42 combined with each of first reception grooves 32 formed on the body 30. Since the first coupling part 42 has a smaller size than the sectional size of the first reception groove 32, the first coupling part 42 may move within the first reception groove 32 when external force is applied to the first coupling part 42. That is, the first coupling part 42 may move within the first reception groove 32 by centrifugal force generated when the body 30 is rotated and/or frictional force generated when the auxiliary member 40 contacts a cleaned surface.

First through holes 34 through which the auxiliary members 40 are exposed to the outside are formed on the body 30. Since the first through hole 34 has a smaller size that the sectional size of the first coupling part 42, separation of the auxiliary member 40 from the first through hole 34 may be prevented. That is, since the width of the first coupling part 42 is greater than that of the first through hole 34, the first coupling part 42 is not separated from the first through hole 34.

The auxiliary members 40 may prevent foreign substances having a long length, such as hair, from being wound on the agitator 20. That is, the auxiliary members 40 are movable differently from the brush members 60 when the body 30 is rotated and thus, at the moment when foreign substances are wound on the agitator 20, the auxiliary members 40 collide with the foreign substances and move. For example, at the moment when hair is sucked into the suction nozzle 200, the auxiliary members 40 hit the hair and thus, the hair is not wound on the agitator 20 or the brush members 60 but may be momentarily guided to the suction channel 270 by suction force.

The protrusion 274 overlapping with a part of the brush member 60 and contacting the brush member 60 when the body 30 is rotated is provided in the suction channel 270. The protrusion 274 is provided so as to face downward from the upper portion of the entrance 272 of the suction channel 270 and, while the body 30 is rotated upward from a region below the protrusion 274, foreign substances may be hung on the protrusion 274.

The brush members 60 are formed of a material which is easily deformable as compared to the auxiliary members 40. Therefore, as the body 30 is rotated, when one end of the brush member 60 contacts the protrusion 274, the end of the brush member 60 is deformed. Then, when the body 30 is rotated by a greater angle, the brush member 60 sweeps the protrusion 274 up and then passes through the protrusion 274. Therefore, when the brush member 60 collides with the protrusion 274, a loud noise is not generated.

The protrusion 274 may shield a part of the length of the entrance 272 in the width direction. If the protrusion 274 shields the entirety of the entrance 272, suction force of air and foreign substance through the suction channel 270 is reduced.

The protrusion 274 may be disposed at the center of the body 30. In this case, the protrusion 274 is not disposed throughout the overall length of the body 30 and thus contacts a part of the brush member 60 extended in the lengthwise direction. In general, when the body 30 is rotated, the protrusion 274 contacts the brush member 60 and disturbs rotation of the body 30. Therefore, the protrusion 274 contacts a part of the brush member 60 and may not greatly disturb rotation of the body 30.

Further, since the protrusion 274 protrudes toward a part of the agitator 20 in the lengthwise direction, force disturbing rotation of the agitator 20 by the protrusion 274 is not great and thus overload during rotation of the agitator 20 is not generated.

The protrusion 274 may be formed integrally with the suction channel 270 and prevent foreign substances from jamming into a connection region between the protrusion 274 and the suction channel 270. Particularly, the protrusion 274 is extended into a curved shape having an increased cross-sectional area in the upward direction of the suction channel 270 and thus hanging of foreign substances onto the protrusion 274 may be prevented.

The brush members 60 may extend from the center of rotation of the body 30 to a greater length than the auxiliary members 40. While the body 30 is rotated, foreign substances may be hung on the brush members 60 rather than on the auxiliary members 40. The reason for this is that the auxiliary members 40 are movable relative to the body 30 and thus, there is a small possibility that foreign substances will be hung on the auxiliary members 40. On the other hand, the brush members 60 are fixed to the body 30 and thus, there is a good possibility that foreign substances will be hung on the brush members 60.

The auxiliary members 40 may not contact the protrusion 274. That is, the auxiliary members 40 may be extended so as not to contact the protrusion 274 even when the body 30 is rotated. Differently from the brush member 60, the auxiliary member 40 may be one member formed of a material, such as rubber or plastic. Therefore, when the auxiliary member 40 contacts the protrusion 274 while the body 30 is rotated, load rotating the body 30 may be increased and noise due to collision between the auxiliary member 40 and the protrusion 274 may be generated. On the other hand, since the brush member 60 includes plural bristles, even if the brush member 60 collides with the protrusion 274, the brush member 60 is easily deformed and generates little noise, as compared to the auxiliary member 40.

Particularly, a recess 46 may be formed at a position of the auxiliary member 40 corresponding to the protrusion 274. Since the auxiliary member 40 is loosely combined with the body 30, there may be a possibility that the auxiliary member 40 collides with the protrusion 274 due to movement of the auxiliary member 40 relative to the body 30. Therefore, the recess 46 having a greater size that one end of the protrusion 274 may be formed on the auxiliary member 40 to prevent collision of the auxiliary member 40 with the protrusion 274.

The number of the auxiliary members 40 may be twice the number of the brush members 60 on the body 30.

One auxiliary member 40 may be disposed at each of both sides of one brush member 60. That is, two auxiliary members 40 may be disposed around one brush member 60. For example, if three brush members 60 are disposed on the body 30, six auxiliary members 40 may be disposed.

Two auxiliary members 40 disposed adjacent to one brush member 60 may hit foreign substances at the moment when the foreign substances are hung on the brush member 60, thus preventing the foreign substances from being hung on the brush member 60.

A vacuum cleaner might comprises: a suction nozzle housing; an agitator (20) provided within the suction nozzle housing; and a suction channel (270) guiding air sucked into the suction nozzle housing to a dust collector, wherein the agitator (20) includes: a body (30) rotatably installed in the suction nozzle housing; brush members (60) disposed on the body (30) in parallel with the center axis of rotation of the body (30) and combined with the body (30) so as to be fixed thereto; and auxiliary members disposed on the body (30) in parallel with the center axis of rotation of the body (30) and loosely combined with the body (30) so as to be pivotable in circumferential direction of the body (30) when the body (30) is rotated, wherein a protrusion (274) having a blunt end is provided in the suction channel (270), the protrusion (274) being arranged to overlap with parts of the brush members (60) and to contact the brush members (60) when the body (30) is rotated.

The protrusion (274) might be provided at the upstream entrance (272) of the suction channel (270).

The protrusion (274) might be provided at the upper portion of the entrance (272) of the suction channel (270); and the center axis of rotation of the body (30) might be at a lower level than the blunt end of the protrusion (274).

The protrusion (274) might be disposed at a position of the entrance of the suction channel (270) corresponding to the lengthwise center of the body (30) and shields a part of the cross-section of the entrance (272) in the widthwise direction.

The protrusion (274) might be formed integrally with the suction channel (270).

The brush members (60) might extend radially from the center axis of rotation of the body (30) to a greater length than the auxiliary members (40).

The brush members (60) might be formed from a material being more easily deformable than the material of the auxiliary members (40).

The auxiliary members (40) might extend radially so as not to contact the protrusion (274).

A recess (46) might be formed at a position of each of the auxiliary members (40) corresponding to the protrusion (274).

The body (30) might include reception grooves (32) extending parallel to the center axis of rotation of the body (30); each of the auxiliary members might include a coupling part (42) received in a corresponding reception groove (32); and the coupling part (42) might have a smaller cross-sectional size in circumferential direction of the body (30) than the cross-sectional size of the reception groove (32) so as to be pivotable within the reception groove (32) in circumferential direction of the body (30).

Two auxiliary members might be disposed between each two neighboring brush members (60) along the circumference of the body (30).

The two auxiliary members (40) might be disposed adjacent to the one brush member (60) interposed therebetween.

The number of the auxiliary members (40) might be twice the number of the brush members (60) on the body (30).

The body (30) might comprise first through holes (34) through which the auxiliary members (40) are radially exposed to the outside.

Each of the first through holes (34) might have a smaller circumferential width than the cross-sectional size in circumferential direction of the body (30) of the first coupling part (42).

As apparent from the above description, a vacuum cleaner in accordance with one embodiment of the present invention prevents foreign substances from jamming in an agitator and thus, a user does not need to remove the foreign substances from the agitator.

Further, the vacuum cleaner in accordance with the embodiment of the present invention prevents overload from being applied to a motor rotating the agitator due to foreign substances when the agitator is rotated.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A vacuum cleaner comprising:

a suction nozzle housing;

an agitator provided within the suction nozzle housing; and a suction channel guiding air sucked into the suction nozzle housing to a dust collector, wherein the agitator includes:

a body rotatably installed in the suction nozzle housing;

brush members disposed on the body in parallel with the center axis of rotation of the body and combined with the body so as to be fixed thereto; and auxiliary members disposed on the body in parallel with the center axis of rotation of the body and loosely combined with the body so as to be movable in a circumferential direction of the body when the body is rotated, wherein a protrusion having a blunt end is provided in the suction channel, the protrusion being arranged to overlap with parts of the brush members and to contact the brush members when the body is rotated, and wherein a recess is formed in each of the auxiliary members at a position which aligns with the protrusion.

2. The vacuum cleaner according to claim 1, wherein the protrusion is provided at an upstream entrance of the suction channel.

3. The vacuum cleaner according to claim 2, wherein:

the protrusion is provided at an upper portion of the entrance of the suction channel; and the center axis of rotation of the body is at a lower level than the blunt end of the protrusion.

4. The vacuum cleaner according to claim 3, wherein the protrusion is disposed at a position of the entrance of the suction channel corresponding to a lengthwise center of the body and shields a part of a cross-section of the entrance in a widthwise direction.

5. The vacuum cleaner according to claim 1, wherein the protrusion is formed integrally with the suction channel.

6. The vacuum cleaner according to claim 1, wherein the brush members extend radially from the center axis of rotation of the body to a greater length than the auxiliary members.

7. The vacuum cleaner according to claim 1, wherein the brush members are formed from a material being more easily deformable than the material of the auxiliary members.

8. The vacuum cleaner according to claim 1, wherein the auxiliary members extend radially so as not to contact the protrusion.

9. The vacuum cleaner according to claim 1, wherein:

the body includes reception grooves extending parallel to the center axis of rotation of the body;

each of the auxiliary members includes a coupling part received in a corresponding reception groove; and the coupling part has a smaller cross-sectional size in the circumferential direction of the body than the cross-sectional size of the reception groove so as to be movable within the reception groove in the circumferential direction of the body.

10. The vacuum cleaner according to claim 1, wherein two auxiliary members are disposed between each two neighboring brush members along a circumference of the body.

11. The vacuum cleaner according to claim 10, wherein the two auxiliary members are disposed adjacent to one of the brush members interposed therebetween.

12. The vacuum cleaner according to claim 10, wherein the number of the auxiliary members is twice the number of the brush members on the body.

13. The vacuum cleaner according to claim 1, wherein the body comprises first through holes through which the auxiliary members are radially exposed to outside the roller.

14. The vacuum cleaner according to claim 13, wherein each of the first through holes has a smaller circumferential width than a cross-sectional size in the circumferential direction of the body of a first coupling part included in the auxiliary members.

15. The vacuum cleaner according to claim 1, further comprising a drive motor installed in the suction nozzle housing and connected to the agitator to rotate the agitator.

16. The vacuum cleaner according to claim 1, wherein the suction nozzle housing includes:

a base plate;

a top plate covering an upper surface of the base plate and forming a space in which the agitator is received; and a transparent plate installed on the top plate and allowing a user to observe the agitator.

* * * * *